US010688533B2

(12) United States Patent
Nijland

(10) Patent No.: US 10,688,533 B2
(45) Date of Patent: Jun. 23, 2020

(54) ELIMINATOR FOR DETECTING AND REMOVING PRODUCTS SUCH AS VEGETABLES AND FRUIT SINGULATOR AND SORTING SYSTEM PROVIDED THEREWITH AS WELL METHOD THEREFOR

(71) Applicant: DE GREEF'S WAGEN-, CARROSSERIE- EN MACHINEBOUW B.V, Tricht (NL)

(72) Inventor: Wilhelm Jan Nijland, Veenendaal (NL)

(73) Assignee: DE GREEF'S WAGEN-, CARROSSERIE- EN MACHINEBOUW B.V, Tricht (NL)

( * ) Notice: Subject to any disclaimer, the term of this patent is extended or adjusted under 35 U.S.C. 154(b) by 0 days.

(21) Appl. No.: 16/071,806

(22) PCT Filed: Jan. 24, 2017

(86) PCT No.: PCT/NL2017/050044

§ 371 (c)(1),
(2) Date: Jul. 20, 2018

(87) PCT Pub. No.: WO2017/131512

PCT Pub. Date: Aug. 3, 2017

(65) Prior Publication Data

US 2019/0039099 A1 Feb. 7, 2019

Related U.S. Application Data

(60) Provisional application No. PCT/NL2017/050044, filed on Jan. 24, 2017.

(30) Foreign Application Priority Data

Jan. 25, 2016 (NL) ..... 2016146

(51) Int. Cl.

| | |
|---|---|
| ***B07C 5/36*** | (2006.01) |
| ***B07C 5/02*** | (2006.01) |
| ***B07B 13/16*** | (2006.01) |

(52) U.S. Cl.
CPC ..... *B07C 5/02* (2013.01); *B07B 13/16* (2013.01); *B07C 5/362* (2013.01);
(Continued)

(58) Field of Classification Search
CPC .... B07C 5/02; B07C 5/10; B07C 5/18; B07C 5/342; B07C 5/3422; B07C 5/362;
(Continued)

(56) References Cited

U.S. PATENT DOCUMENTS 3,730,325 A 5/1973 Goodwin
5,477,955 A * 12/1995 Madden ..... B07B 13/16 198/370.04

(Continued)

FOREIGN PATENT DOCUMENTS

DE 4332461 A1 8/1994
FR 2814383 A1 * 3/2002 ..... B07C 5/36

(Continued)

OTHER PUBLICATIONS

English Translation of FR 2814383 A1; Inv: Fachaux; Jean; Pub: Mar. 2002 (Year: 2002).*

(Continued)

*Primary Examiner* — Joseph C Rodriguez
(74) *Attorney, Agent, or Firm* — Shook, Hardy & Bacon L.L.P.

(57) ABSTRACT

An eliminator for detecting and removing products, such as vegetables and fruit, which are oversized and/or have undesired product properties, and a singulator and sorting system provided therewith, and a method therefor. The eliminator comprises a feed system for supplying products, a detector configured to determine dimensions and/or product properties of a product of the supplied products, a controller operatively connected to the detector and configured to determine on the basis of determined dimensions and/or (Continued)

product properties of the product whether the product is suitable for processing in a sorting device, and a remover operatively connected to the controller for separating products which are not suitable for processing in the sorting device from products which are suitable for processing in the sorting device.

19 Claims, 6 Drawing Sheets

(52) U.S. Cl.
CPC ..... *B07C 2501/009* (2013.01); *B07C 2501/0063* (2013.01); *B07C 2501/0081* (2013.01)

(58) Field of Classification Search
CPC ..... B07C 2501/009; B07C 2501/0063; B07C 2501/0081; B65G 47/252; B65G 2201/0211
See application file for complete search history.

(56) References Cited

U.S. PATENT DOCUMENTS 5,513,740 A * 5/1996 Affeldt ..... B07C 5/02 198/460.1
6,234,300 B1 * 5/2001 De Vos ..... B07C 5/18 198/370.03
6,659,287 B1 * 12/2003 Hawkins ..... B07C 5/36 198/483.1
6,805,245 B2 * 10/2004 Kenneway ..... B07C 5/342 209/538
7,280,198 B2 * 10/2007 Blanc ..... G01B 11/00 209/701
9,734,569 B2 * 8/2017 Beach ..... G06T 7/0004
9,919,345 B1 * 3/2018 Lu ..... B07C 1/04
10,220,417 B2 * 3/2019 Ritondo ..... B07C 5/02
2005/0000299 A1 1/2005 Vogel et al.
2018/0154396 A1 * 6/2018 Ritondo ..... B07C 5/12

FOREIGN PATENT DOCUMENTS

WO 2004030835 A1 4/2004
WO 2015158962 A1 10/2015
WO WO-2019115840 A1 * 6/2019 ..... B31B 70/006

OTHER PUBLICATIONS

International Search Report and Written Opinion dated Apr. 20, 2017 in International Patent Application No. PCT/NL2017/050044, 10 pages.

* cited by examiner

ELIMINATOR FOR DETECTING AND REMOVING PRODUCTS SUCH AS VEGETABLES AND FRUIT SINGULATOR AND SORTING SYSTEM PROVIDED THEREWITH AS WELL METHOD THEREFOR

CROSS-REFERENCE TO RELATED APPLICATIONS

This application claims priority under 35 U.S.C. § 365 to PCT/NL2017/050044, filed on Jan. 24, 2017, entitled "ELIMINATOR FOR DETECTING AND REMOVING PRODUCTS, SUCH AS VEGETABLES AND FRUIT, SINGULATOR AND SORTING SYSTEM PROVIDED THEREWITH, AS WELL METHOD THEREFOR," which claims priority to Netherlands App. No. 2016146 filed on Jan. 25, 2016, the entirety of the aforementioned applications are incorporated by reference herein.

The present invention relates to a method for detecting and removing from a batch products which are not suitable for sorting, including oversized and/or diseased products. These for instance oversized and/or diseased products are more particularly removed prior to sorting thereof with a sorting device. The products are particularly vegetables and fruit, and more particularly fresh fruit such as apples and pears.

Sorting systems for sorting vulnerable products, particularly vegetables and fruit such as apples and pears, are known in practice. Such a conventional sorting system is for instance described in NL 2003166. This describes in particular a holder for sorting and/or transporting such products. In the sorting systems known in practice a quantity of product is supplied, then singulated, after which one or more measurements are performed on the product using a measuring system. On the basis of the performed measurements the product is allocated to a sorting class associated with the relevant product, and is transported in the sorting device with the above stated holder to a sorting outlet of the sorting device which corresponds to this sorting class. The sorting outlets are usually embodied in the form of sorting channels, particularly water channels. The sorting outlets of the sorting device are set to a classification associated with the relevant product variety or product type, wherein each sorting class is coupled to one or more outlets of the sorting device.

A problem occurring in practice during sorting of products is the relatively great variation in dimensions such products can have. Products which are too large for the sorting system in particular can damage this system and/or slow down or even shut down the sorting process. A transfer part, for instance embodied as a transfer unit, between a singulator and sorting device can thus for instance be damaged by oversized products. It is likewise possible that measuring and classifying of oversized products cannot be performed correctly, for instance because a measuring system treats an oversized product as two individual products. An oversized product can also cause a problem in the sorting device in that products lie against each other and/or the product for instance exceeds the pitch between individual carriers of the sorting device. This prevents correct processing of these products, possibly resulting in damage and/or standstill. Another problem occurring in practice is that products with a disease, for instance rot, can contaminate or infect an installation or system. This can result in considerable damage. In the case of for instance a sorting device which makes use of water channels as sorting channels an infected or diseased product can contaminate or infect the water flow, so that other products become infected or diseased and/or a cleaning of the system is required.

The object of the present invention is to provide an eliminator which enables an effective and efficient sorting of products, such as vegetables and fruit.

The present invention provides for this purpose an eliminator for detecting and removing products unsuitable for sorting, such as vegetables and fruit, prior to sorting of the products with a sorting device, wherein the eliminator comprises:

- a feed system for supplying products;
- a detector configured to determine dimensions and/or product properties of a product of the supplied products;
- a controller operatively connected to the detector and configured to determine on the basis of determined dimensions and/or product properties of the product whether the product is suitable for processing in a sorting device; and
- a remover operatively connected to the controller for separating products which are not suitable for processing in the sorting device from products which are suitable for processing in the sorting device.

An oversized product is a product with dimensions outside the typical range. The products are particularly vegetables and fruit, and more particularly fresh products such as apples and pears. The typical range for a batch of products is also determined by settings employed in the processing operation of these products. Use is thus usually made in the sorting process of a singulator which places products at a mutual centre-to-centre distance. This centre-to-centre distance determines the maximum size of the product. The measuring system also employs a certain distance between two successive products, as well as the sorting device. Such a sorting device, also described in the above stated patent document NL 2003166, is in practice provided with a number of holders or carriers on which products can be placed and wherein the holders or carriers are provided at a mutual distance defined by the pitch. This likewise determines a maximum size for the products to be sorted. It is generally the case that a smaller pitch can result in a greater sorting capacity. A maximum size for processing is therefore in practice adjusted to the maximum product dimensions which still occur with some regularity in a batch. Oversized products therefore fall outside these dimensions and could cause one or more of the above stated problems during the processing operation, particularly the sorting process.

Providing an eliminator according to the invention achieves that oversized products can be separated from the other products in simple manner. According to the invention, use is made here of a detector whereby a measurement can be performed of the dimensions of a product of the supplied product flow. Using a controller it is possible to determine the dimensions on the basis of the measurement data obtained from the detector and to detect an oversized product. It can then be decided whether the product is suitable for processing in a sorting device or must be separated from such products. A remover then provides for the mutual separation of the products deemed suitable for processing in the sorting device and the products deemed unsuitable.

It is alternatively or additionally possible to detect a product with product properties such that it is unsuitable for further processing in a sorting device. Besides being oversized, such product properties are inter alia diseases, particularly rot. Detecting these products immediately before the actual sorting of the products in a sorting device optimizes the chance of successful detection. This prevents infection of the sorting device and products processed thereby. This reduces for instance product wastage and downtime of the process for cleaning purposes. Also in the case of a sorting system wherein use is made of water channels with a closed system can infection and/or contamination of the water system result in damage. The detection of unsuitable products is preferably performed immediately before the actual sorting, most preferably in-line, just before products are carried into the sorting device. It has been found that this enables an effective detection.

The detector preferably comprises a camera or camera system. It has been found that a sufficiently accurate determination of product dimensions and/or product properties can be performed with such a camera. This makes it possible to determine in effective manner whether the product is suitable for further processing with a sorting device or whether the product has to be separated from the product flow to the sorting device since it is considered unsuitable for processing. Alternative or additional detectors are for instance infrared sensors, NIR systems, ultrasonic sensors or other sensors. It is also possible to apply a combination of more than one sensor and/or different types of sensor. A detection of oversized products is particularly combined with detection of products with symptoms of disease, such as rot.

It is likewise possible according to the invention to combine the detector with a measuring system of the sorting device. A determination for the product can in this way be performed in effective manner. In such a combined embodiment the remover has to be positioned, preferably in-line, immediately downstream of the measuring system and upstream of products for instance being placed on a carrier of the sorting device. The eliminator can also be provided as separate modular device. This can for instance be integrated into conventional sorting systems in relatively simple manner.

In a currently preferred embodiment the remover makes use for the detection of the measuring system of the sorting device or the sorting system. This makes it possible to dispense with a separate detector, or to add a desired detector to the already present measuring system. This enables effective application of the remover. This also enables in-line removal of products unsuitable for sorting in the sorting device. This achieves the above stated advantages, including removal of oversized products and restriction of infection risks. The pitch which is employed in the sorting device can in particular be chosen effectively, and it is possible to dispense with a relatively large safety margin, which is usually applied in conventional systems. As already stated, this can increase the capacity of the sorting. The employed pitch of the sorting device is preferably used here to set the remover.

In an advantageous preferred embodiment according to the present invention the remover comprises a knock-out element.

Providing a knock-out element enables a product to be separated from other products of a product flow in simple manner. The knock-out element preferably removes the products from the product flow, for instance by knocking them from the conveyor in a lateral direction.

Said removal in lateral direction of products from the product flow is particularly advantageous in an in-line application of the remover according to the invention.

The remover preferably comprises a pneumatic control. It has been found that an effective control of the remover, particularly the knock-out element, can be realized by making use of a pneumatic control. Other controls are otherwise also possible.

In an advantageous preferred embodiment according to the present invention the eliminator further comprises a discharge conveyor for discharging products which are oversized and/or have unsuitable product properties.

Providing a discharge conveyor enables the products which are oversized and/or have unsuitable product properties to be separated in effective manner from products which are assessed as suitable for further sorting. The remover preferably knocks the products which are oversized and/or have unsuitable product properties off the conveyor and into the product flow in a lateral direction relative to the usual direction of movement in the sorting process. The discharge conveyor is preferably provided such that it receives the removed products which are oversized and/or have unsuitable product properties, and transports them further. In a currently preferred embodiment the discharge conveyor is provided in lateral direction or transverse direction of the usual direction of the product flow and extends wholly or partially under the conveyor of the sorting system in the product flow. It will be apparent that other configurations of the discharge conveyor according to the invention can also be provided.

The conveyor which is provided in lateral direction is preferably applied in combination with a knock-out element suitable for removal in lateral direction of products assessed as unsuitable for sorting in the sorting device. In a currently preferred embodiment the knock-out element is provided here with an arm arranged rotatably around a pivot shaft of the remover and/or eliminator such that a rotation movement can be performed by the knock-out element in a direction substantially at a right angle to the regular supply direction of the products.

The invention also relates to a singulator for singulating products, wherein the singulator comprises an eliminator as described above.

Such a singulator provides the same advantages and effects as described for the eliminator. Such a singulator further preferably has a discharge conveyor for discharging products which are oversized and/or have unsuitable product properties, wherein the discharge conveyor extends at least partially under the transport means of the singulator, such that products removed laterally from the singulator are received. This enables an effective sorting process. In a currently preferred embodiment for the singulator the conveyor in the product flow comprises a diabolo bed. It has been found that an effective transport of products is possible with such a diabolo bed.

The invention further also relates to a sorting system for sorting products, such as vegetables and fruit, the sorting system comprising:

- an eliminator, or a singulator provided therewith, as described above; and
- a sorting device provided with a measuring system, wherein the sorting device is configured to sort on the basis of product measurements performed by the measuring system products deemed suitable by the eliminator to be processed in the sorting device.

The sorting system provides the same advantages and effects as described for the eliminator and/or singulator. The sorting system is preferably provided with a singulator with eliminator, a sorting device provided with sorting channels and a transfer unit for transferring products from the singulator to the sorting device. The sorting system can particularly operate in effective manner because oversized products are removed, this preventing damage to parts of the sorting system, obstruction or standstill of parts of the sorting system and/or the occurrence of damage, including possible infection, in other products. It is hereby possible to realize less damage, standstill and product loss compared to conventional sorting systems. Maintenance and repair costs are also lower.

The eliminator is preferably arranged in a product flow upstream of the measuring system of the sorting system and a transfer unit for placing in carriers or holders products deemed suitable for sorting. The carriers or holders form part of the sorting device which transports classified products to the desired sorting outlets or sorting channels. The eliminator is in this embodiment preferably provided as a modular unit which is for instance applicable in both new and conventional sorting systems.

In an alternative embodiment according to the invention the remover of the eliminator is arranged between the measuring system of the sorting system and a transfer unit as described above. It is hereby possible to integrate the detector of the eliminator with the measuring system of the sorting system such that an effective sorting system can be realized. Damage in the sorting device can be avoided by removing products which have been determined to be oversized and/or have unsuitable product properties using the remover before they are placed on carriers or holders of the sorting device by the transfer unit. It has been found that the removal is preferably performed in-line, immediately before the products are carried into the sorting device, for instance using the transfer unit.

The invention further also relates to a method for detecting and removing oversized products prior to the sorting of products with a sorting device, wherein the method comprises of:

- providing an eliminator or a singulator provided therewith, as described above;
- supplying the products to the eliminator with the feed system;
- determining dimensions and/or product properties of a product of the supplied products using the detector;
- determining by means of the controller which is operatively connected to the detector and on the basis of determined dimensions and/or product properties of the product whether the product is suitable for processing in a sorting device; and
- separating products unsuitable for processing in the sorting device from the products deemed suitable for the sorting device using the remover.

The method provides the same advantages and effects as described above for the eliminator, singulator provided therewith, and sorting system provided with such an eliminator or singulator. A sorting process for vulnerable products, particularly vegetables and fruit such as apples and pears, can be performed in effective manner by removing oversized products and/or products with product properties such as a disease, particularly rot. Damage to equipment and/or products is prevented here as far as possible.

The method preferably further comprises the step of transferring products suitable for processing in a sorting device from the singulator to a carrier or holder of the sorting device using a transfer unit. Such a product which is deemed suitable can then be sorted and be delivered to a desired sorting outlet, for instance formed by a sorting channel, using the sorting device.

The pitch applied in the sorting device can in particular be chosen effectively, and a relatively large safety margin, which is usually applied in conventional systems, can be dispensed with. As stated above, this can increase the capacity of the sorting. The employed pitch of the sorting device is preferably used here to set the remover.

Further advantages, features and details of the invention are further elucidated below on the basis of preferred embodiments thereof, wherein reference is made to the accompanying drawings, in which.

Figure 1A:
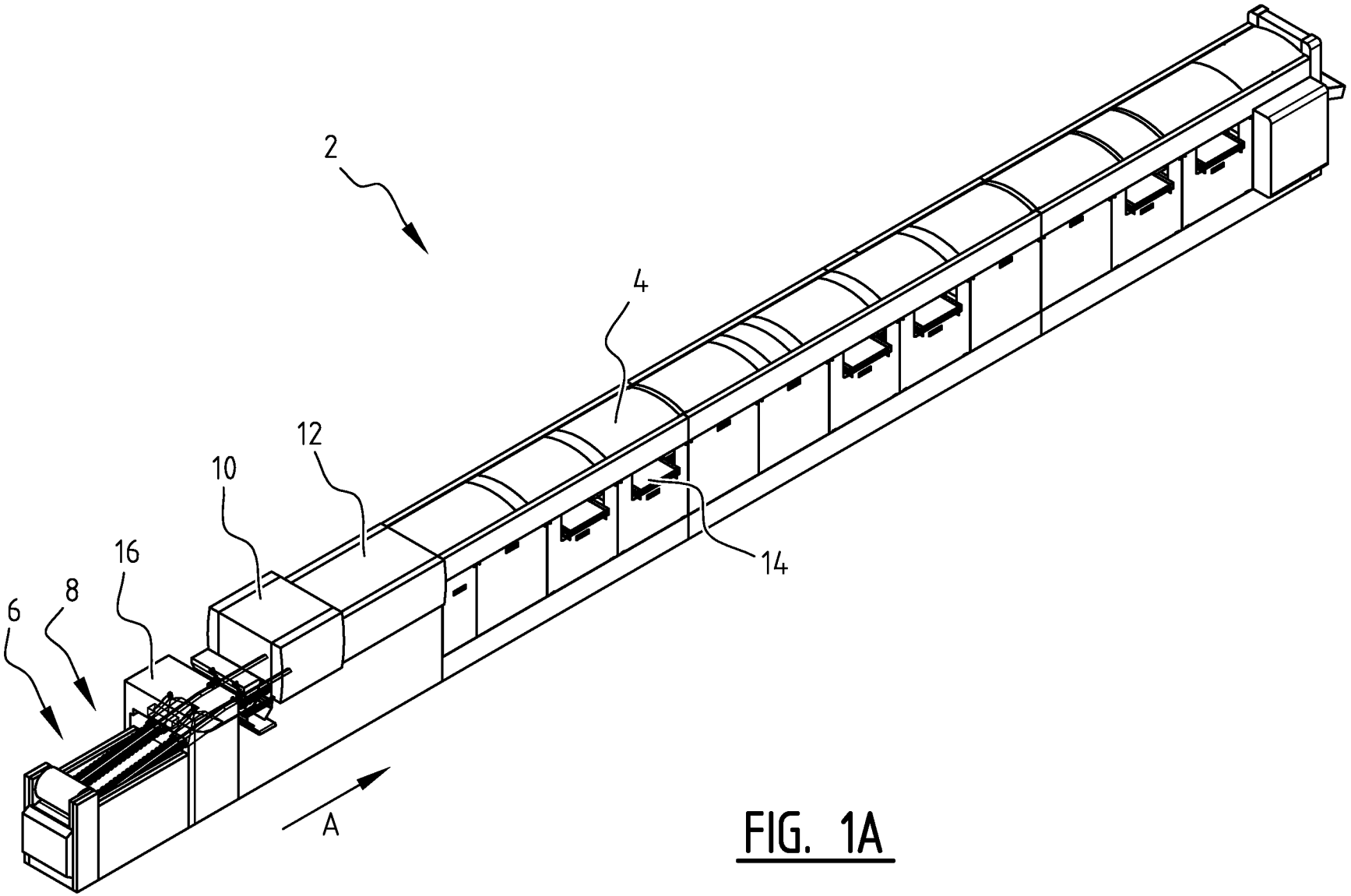
FIG. 1A shows a view of a sorting system, wherein sorting channels are omitted for the sake of clarity.

Sorting system 2 (FIG. 1A) comprises sorting device 4 and feed system 6 provided with singulator 8. Sorting system 2 is in the shown embodiment further provided with a measuring system in the form of measuring or classification system 10, and transfer device 12 whereby products P are placed in a bed of transport holders of sorting device 4. Sorting device 4 further comprises a large number of sorting channels 14. The outlet of sorting channels 14 is operatively connected to a discharge system. Sorting channels 14 can thus for instance be provided with water channels, and the discharge system can be provided with a number of crates fillers and crate stackers.

Figure 1B:
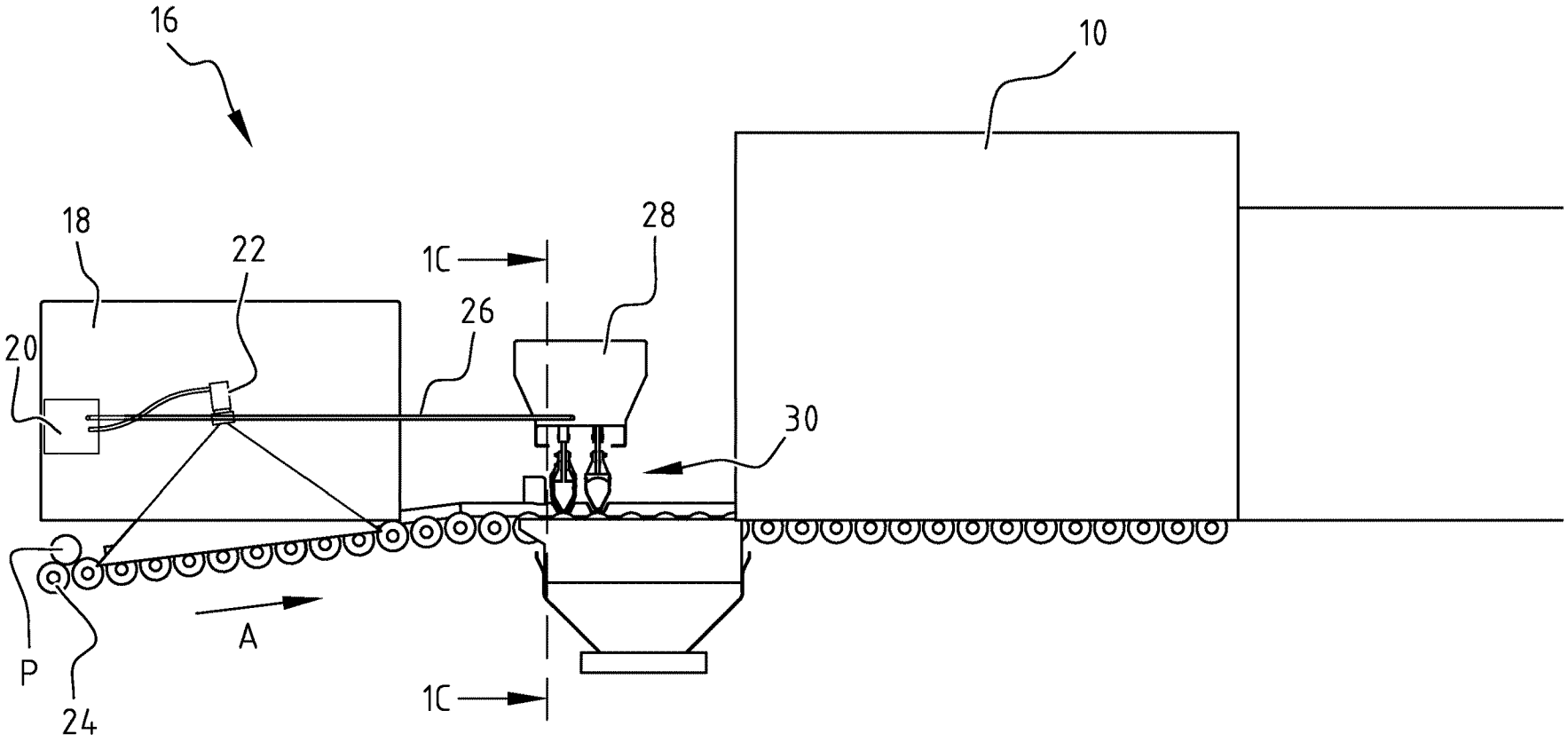
FIGS. 1B and 1C show views of the eliminator according to the invention.

Transfer eliminator 16 is situated upstream of measuring system 10 in sorting system 2, as seen in the direction of usual product flow A. Eliminator 16 (FIG. 1B) is provided with measuring system 18, wherein use is made of measuring control 20 and camera 22. It will be apparent that other types of sensor can also be applied according to the invention in measuring system 18. A product P is supplied via diabolo bed 24 in direction A. Control 20 is connected via connection 26 to remover 28.

Figure 1C:
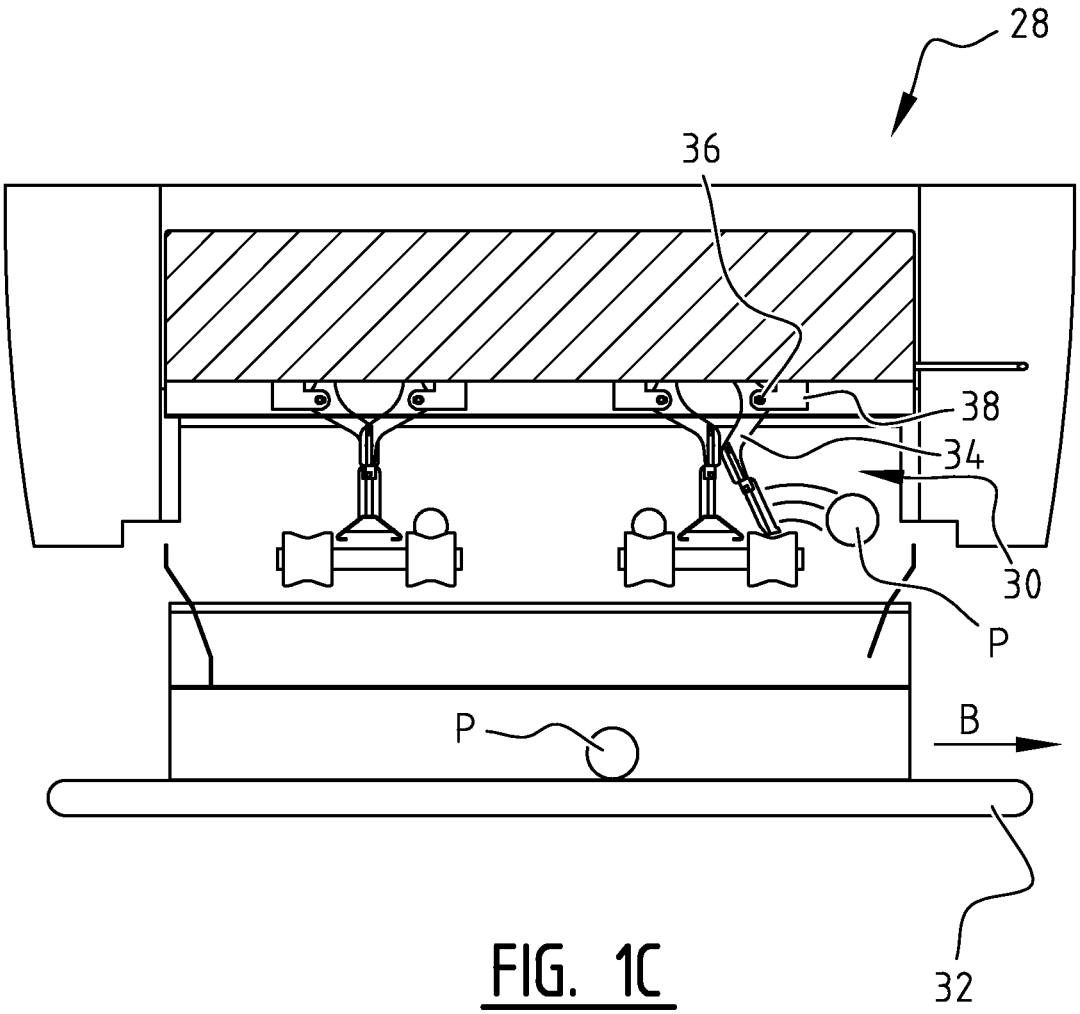

Remover 28 comprises a number of knock-out elements 30 (FIG. 1C) which are activated on the basis of product information obtained with measuring system 18. In the shown embodiment products P are knocked off diabolo bed 24 and received by conveyor 32 which discharges products in transport direction B. In the shown embodiment discharge direction B is transverse of supply direction A.

In the shown embodiment knock-out element 30 with arm 34 is arranged rotatably around pivot shaft 36 of attachment 38 of remover 28. A rotation movement can hereby be performed in simple manner by activation of knock-out element 30, whereby knock-out element 30 pushes an oversized and/or diseased product P laterally off conveyor 24. It will be apparent that other embodiments are also possible for remover 28.

Figure 2A:
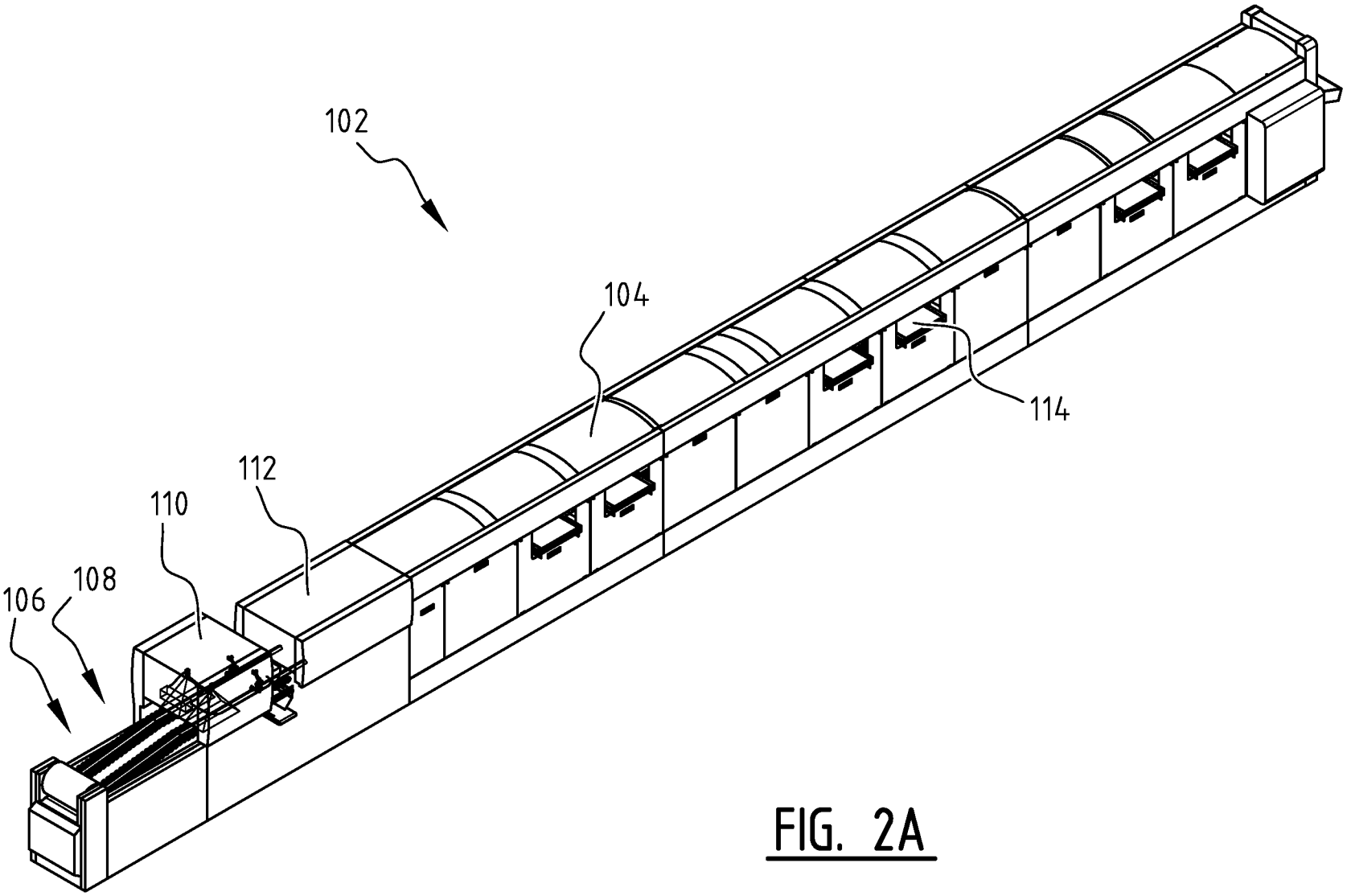
FIG. 2A shows a view of an alternative sorting system with integrated eliminator according to the invention.

In an alternative embodiment sorting system 102 (FIG. 2A) is likewise provided with sorting device 104 and feed system 106 with singulator 108. Measuring system 110 performs one or more measurements on products P of the product flow, after which transfer unit 112 places the products in the carriers or holders of sorting device 104, whereby products P are transported to sorting outlets 114.

Figure 2B:
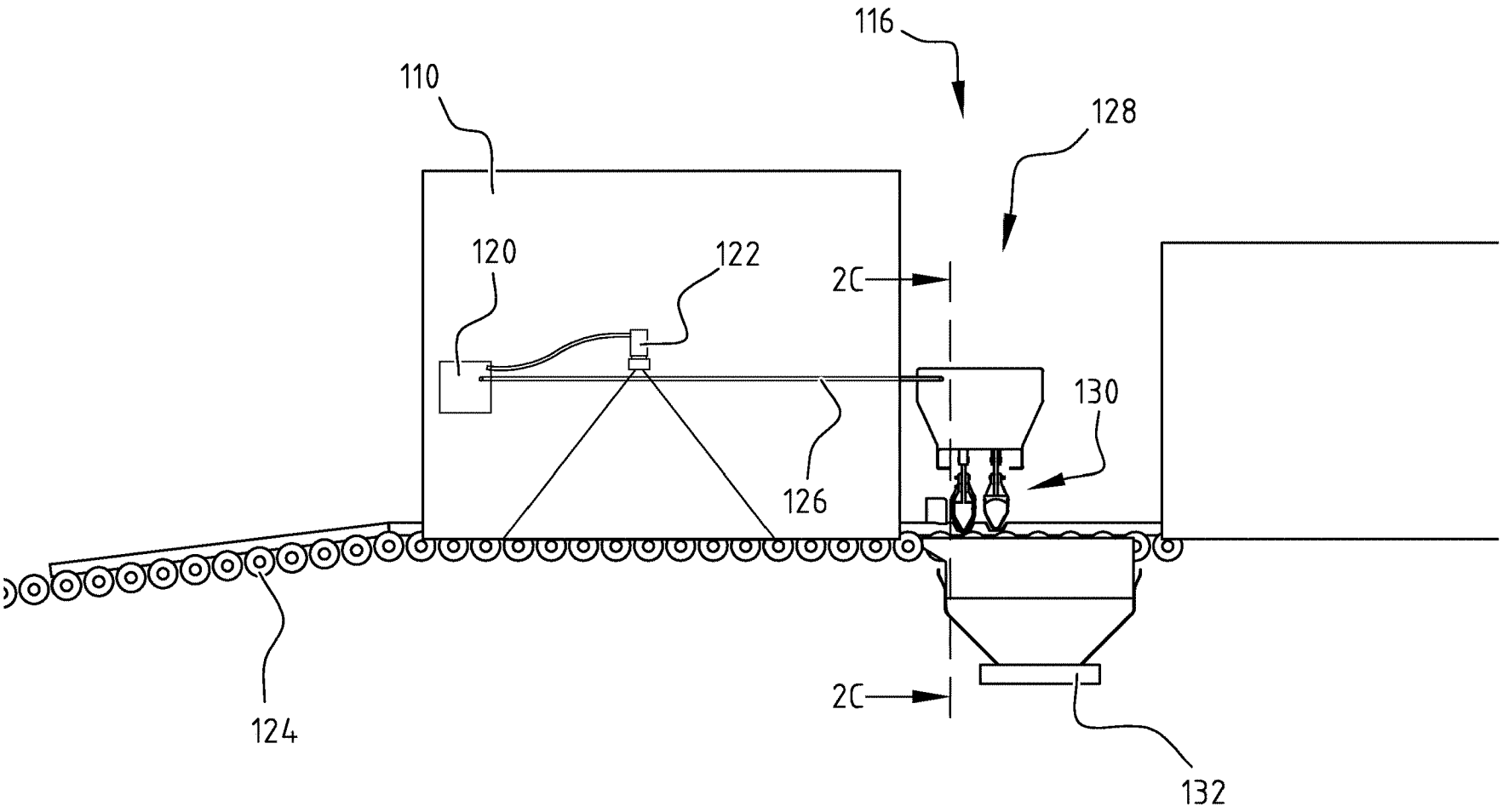
FIGS. 2B-C show views of the eliminator of the sorting system of FIG. 2A.
Figure 2C:
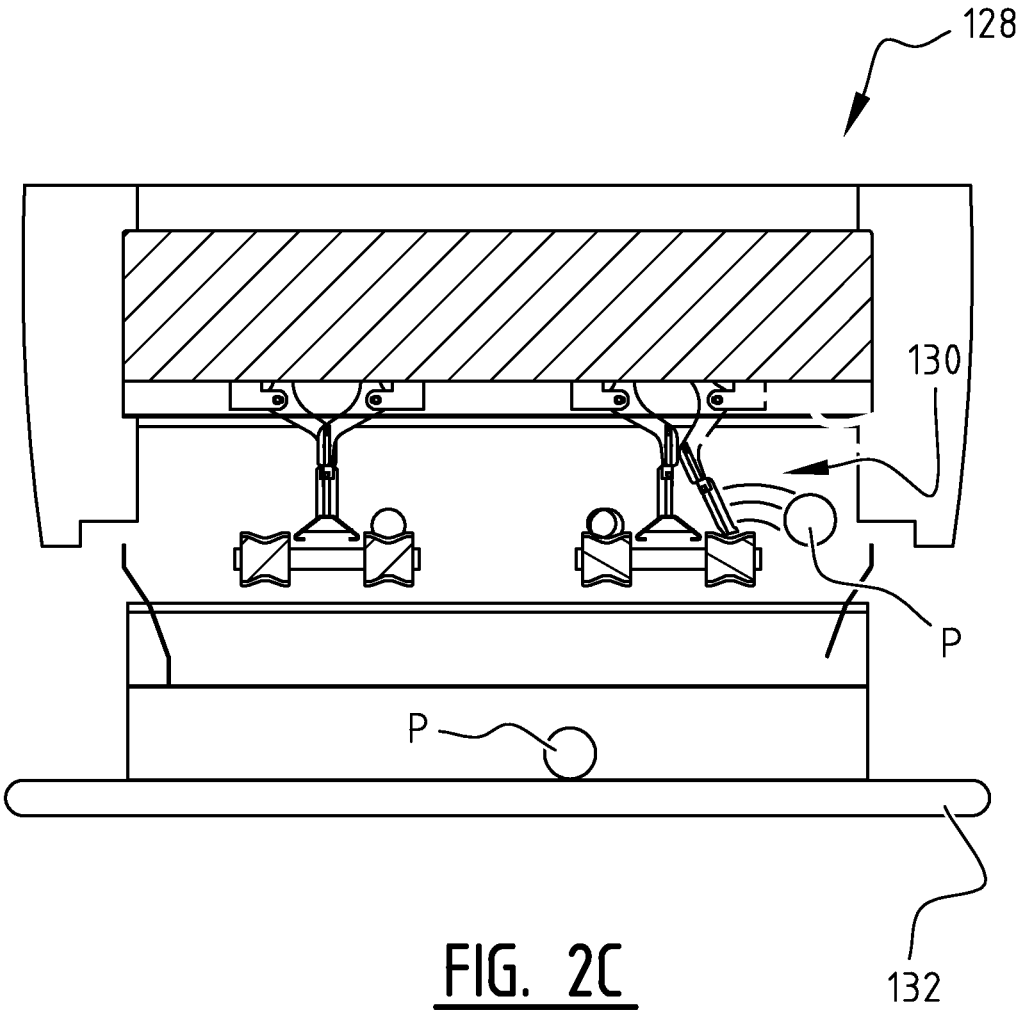

Sorting system 102 is further provided with eliminator 116 (FIG. 2B) whose measuring system is combined with measuring system 110. In this integrated embodiment measuring system 110 also comprises a camera 122 and control 120 whereby a detection of oversized dimensions and/or detection of undesired properties such as rot can also take place, in addition to a classification of products P. Eliminator 116 further comprises remover 128 provided with knock-out elements 130 and discharge conveyor 132. Remover 128 is in this embodiment provided in-line, downstream of measuring system 110 and upstream of transfer unit 112.

The operative connection 126 between control 120 and remover 128 enables product P, which is oversized and/or has undesired properties, to be removed from diabolo bed 124 at the correct moment by knock-out element 130. Discharge conveyor 132 discharges products which are oversized and/or have undesired product properties, such as rot, for further processing.

Products P of a product flow which is supplied in a direction A toward sorting system 2, 102 have a relatively great variety of dimensions, for instance product diameter. Products P can also have undesired product properties, including rot. This is particularly the case in a product flow consisting of fresh products, such as vegetables and fruit. In order to prevent problems during processing, a detection of products P having excessive dimensions and/or undesired product properties is performed with eliminator 16, 116. This detection takes place before products reach sorting device 4, 104. This means that eliminator 16, 116 is provided upstream of products reaching transfer unit 12, 112. The most optimal possible pitch of the holders or carriers of sorting device 4, 104 can in this way be chosen in a possible embodiment. Infection of other products and/or sorting device 4, 104 can alternatively or additionally be prevented.

In the different embodiments the eliminator is placed upstream of measuring system 10, 110 of sorting system 2, 102, downstream of measuring system 10, 110, or can be fully or partially integrated therewith. This integration for instance relates to the measuring part of the sorting system and the eliminator.

Products which are detected by measuring system 18, 110 as products which are oversized and/or have undesired product properties are removed from conveyor 24 of singulator 8, 108 by remover 28, 128. Removed products which are oversized and/or have undesired product properties are preferably received by discharge conveyor 32, 132 and optionally further processed. Products which are not removed are then sorted on sorting device 4, 104 and carried to the correct sorting channels 14, 114 on the basis of classification determined by measuring system 10, 110. This reduces the number of disruptions in sorting system 2, 102.

The present invention is by no means limited to the above described preferred embodiments thereof. The rights sought are defined by the following claims, within the scope of which many modifications can be envisaged.

The invention claimed is:

1. An eliminator for detecting and removing products, which are oversized and/or have undesired properties, prior to sorting of the products with a sorting device, wherein the eliminator comprises:

a feed system for supplying products;

a detector configured to determine dimensions and/or product properties of a product of the supplied products;

a controller operatively connected to the detector and configured to determine on the basis of the determined dimensions and/or product properties of the product whether the product is suitable for processing in the sorting device; and a remover operatively connected to the controller for separating products which are not suitable for processing in the sorting device from products which are suitable for processing in the sorting device, wherein the remover comprises a knock-out element and is provided with an arm arranged rotatably around a pivot shaft of the remover and/or the eliminator such that a rotation movement can be performed by the knock-out element in a direction substantially at a right angle in a lateral direction to a regular supply direction of the products.

2. The eliminator as claimed in claim 1, wherein the detector comprises a camera.

3. The eliminator as claimed in claim 1, wherein the knock-out element comprises a pneumatic control therefor.

4. The eliminator as claimed in claim 1, further comprising a discharge conveyor for discharging products which are oversized and/or have undesired product properties which have been separated from products suitable for processing in the sorting device.

5. The eliminator as claimed in claim 2, wherein the knock-out element comprises a pneumatic control therefor.

6. The eliminator as claimed in claim 5, further comprising a discharge conveyor for discharging products which are oversized and/or have undesired product properties which have been separated from products suitable for processing in the sorting device.

7. A sorting system for sorting products the sorting system comprising:

an eliminator, wherein the eliminator comprises:

a feed system for supplying products;

a detector configured to determine dimensions and/or product properties of a product of the supplied products;

a controller operatively connected to the detector and configured to determine on the basis of the determined dimensions and/or product properties of the product whether the product is suitable for processing in a sorting device; and a remover operatively connected to the controller for separating products which are not suitable for processing in the sorting device from products which are suitable for processing in the sorting device; and the sorting device provided with a measuring system, wherein the sorting device is configured to sort on the basis of product measurements performed by the measuring system products deemed suitable by the eliminator to be processed in the sorting device, wherein the remover comprises a knock-out element and is provided with an arm arranged rotatably around a pivot shaft of the remover and/or the eliminator such that a rotation movement can be performed by the knock-out element in a direction substantially at a right angle in a lateral direction to a regular supply direction of the products.

8. The sorting system as claimed in claim 7, further comprising a singulator comprising the eliminator, and further comprising a discharge conveyor for discharging products which are oversized and/or have undesired product properties, wherein the discharge conveyor extends at least partially under a transport device of the singulator, such that products removed laterally from the singulator are received thereby.

9. The sorting system as claimed in claim 7, wherein the feed system comprises a diabolo bed.

10. The sorting system as claimed in claim 7, wherein the eliminator is arranged in a product flow upstream of the measuring system of the sorting system and a transfer unit configured to place products deemed suitable for sorting in carriers of the sorting device.

11. The sorting system as claimed in claim 7, wherein the remover is arranged between the measuring system and a transfer unit configured to place products deemed suitable for sorting in carriers of the sorting device.

12. The sorting system as claimed in claim 8, wherein the eliminator is arranged in a product flow upstream of the measuring system of the sorting system and a transfer unit configured to place products deemed suitable for sorting in carriers of the sorting device.

13. The sorting system as claimed in claim 12, wherein the remover is arranged between the measuring system and a transfer unit configured to place products deemed suitable for sorting in carriers of the sorting device.

14. A method for detecting and removing products which are oversized and/or have undesired product properties, prior to the sorting of the products with a sorting device, the method comprising:

providing an eliminator; wherein the eliminator comprises:

a feed system for supplying products;

a detector configured to determine dimensions and/or product properties of a product of the supplied products;

a controller operatively connected to the detector and configured to determine on the basis of the determined dimensions and/or product properties of the product whether the product is suitable for processing in the sorting device; and a remover operatively connected to the controller for separating products which are not suitable for processing in the sorting device from products which are suitable for processing in the sorting device;

supplying the products to the eliminator with the feed system;

determining dimensions and/or product properties of a product of the supplied products using the detector;

determining by the controller which is operatively connected to the detector and on the basis of determined dimensions and/or product properties of the product whether the product is suitable for processing in the sorting device; and separating products unsuitable for processing in the sorting device from the products deemed suitable for the sorting device using the remover, wherein the remover comprises a knock-out element and is provided with an arm arranged rotatably around a pivot shaft of the remover and/or the eliminator such that a rotation movement can be performed by the knock-out element in a direction substantially at a right angle in a lateral direction to a regular supply direction of the products.

15. The method as claimed in claim 14, further comprising transferring products suitable for processing in the sorting device from a singulator to a carrier of the sorting device using a transfer unit, and further comprising sorting the products which have been deemed suitable using the sorting device.

16. The method as claimed in claim 15, wherein the products unsuitable for processing in the sorting device are removed in-line, immediately before products are carried into the sorting device using the transfer unit.

17. The method as claimed in claim 14, further comprising setting the remover on the basis of a pitch chosen for the sorting device.

18. The method as claimed in claim 15, further comprising setting the remover on the basis of a pitch chosen for the sorting device.

19. The method as claimed in claim 16, further comprising setting the remover on the basis of a pitch chosen for the sorting device.

* * * * *